United States Patent [19]

Skandaliaris et al.

[11] Patent Number: 4,909,169

[45] Date of Patent: Mar. 20, 1990

[54] MULTIPLE HULL BOAT

[75] Inventors: Bill P. Skandaliaris, Oldsmar; Ralph F. White, Blountstown; Nickolas M. Peterson, Pace, all of Fla.

[73] Assignee: Spirit of America, Inc., Tarpon Springs, Fla.

[21] Appl. No.: 203,012

[22] Filed: Jun. 7, 1988

[51] Int. Cl.[4] ..... B63B 7/04

[52] U.S. Cl. ..... 114/61; 114/354

[58] Field of Search ..... 114/61, 344, 354, 123

[56] References Cited

U.S. PATENT DOCUMENTS

| | | | |
|---|---|---|---|
| 2,876,728 | 3/1959 | Luger | 114/61 |
| 2,992,444 | 7/1961 | Schuler | 114/344 |
| 3,792,502 | 2/1974 | Odegaard | 114/344 |

FOREIGN PATENT DOCUMENTS

| | | | |
|---|---|---|---|
| 7508090 | 1/1977 | Netherlands | 114/61 |

*Primary Examiner*—Sherman D. Basinger

*Attorney, Agent, or Firm*—Pettis & McDonald

[57] ABSTRACT

A multiple hull boat is disclosed including a pair of elongate, generally parallel hull members and a collapsible and expandable apparatus for connecting the hull members. There is a central deck section located generally above and between the hull members and having a pair of side edges that extend generally longitudinally of the respective hull members. First and second deck extension sections are mounted to respective hull members and the central deck section is supported relative to the deck extension sections for transverse movement relative to at least the first deck extension section. The hull members are selectively moveable apart such that the deck extension sections are extended at least partly beyond the respective side edges of the central deck section to expand the boat and are moveable together such that at least the first deck extension section is retracted at least partly within a respective side edge of the central deck section to collapse the boat.

22 Claims, 3 Drawing Sheets

MULTIPLE HULL BOAT

FIELD OF THE INVENTION

This invention relates to a multiple hull water vessel and more particularly to a boat of expandable width that may be employed as either a work barge or a pleasure craft.

BACKGROUND OF THE INVENTION

Multiple hull vessels such as pontoon boats are widely employed both as work barges and pleasure craft. Typically such vessels employ a deck area disposed generally between a pair of buoyant hull members. This deck area is preferably constructed as large as possible to provide optimum accommodation for people and equipment. However, if the vessel must be transported occasionally on the highway its large size can prove a great hinderance. Not only does the boat require a fairly large trailer, it may be too wide to be legally transported over the road.

In an attempt to make multiple hull boats more readily transportable, a number of these vessels have been constructed to be collapsible. Certain conventional pontoon boats employ fairly complex gearing or linkage mechanisms for opening and closing the vessels. Others must first be removed from the water and then broken down so that they can be transported. Off course, such boats must be reassembled for subsequent use on the water. This can prove to be tedious and time consuming, particularly when the disassembly and reassembly is performed with the boat removed from the water. Accordingly, a strong need still exists for a multiple hull boat which provides an optimum deck size and yet which may be quickly and conveniently collapsed into a legally transportable size. Additionally, the need exists for a multiple hull vessel that may be quickly and conveniently collapsed and expanded while still afloat.

SUMMARY OF THE INVENTION

It is therefore an object of the invention to provide an improved multiple hull boat that may be quickly and conveniently collapsed and expanded.

This invention features a multiple hull boat that includes a pair of elongate generally parallel hull members and a collapsible and expandable apparatus for interconnecting the hull members. A central deck section located generally above and between the hull members has a pair of side edges that extend generally longitudinally of the respective hull members. There are first and second deck extension sections mounted respectively to the hull members. The central deck section is supported relative to the deck extension sections for transverse translational movement relative to at least the first deck extension section. The hull members are selectively moveable apart such that the deck extension sections are extended at least partly beyond the respective side edges of the central deck section to expand the boat. The hull members are also moveable toward one another such that at least the first deck extension section is retracted at least partly within a respective side edge of the central deck section to collapse the boat.

In preferred embodiments central deck section is supported for transverse movement relative to both the first and second deck extension sections. The supporting means may include a plurality of rollers. A drive mechanism is preferrably provided for selectively moving the hull members apart and together.

BRIEF DESCRIPTION OF THE DRAWINGS

A particularly preferred embodiment of the apparatus of this invention will be described in detail below in connection with the illustrations in which.

DESCRIPTION OF A PREFERRED EMBODIMENT

Figure 1:
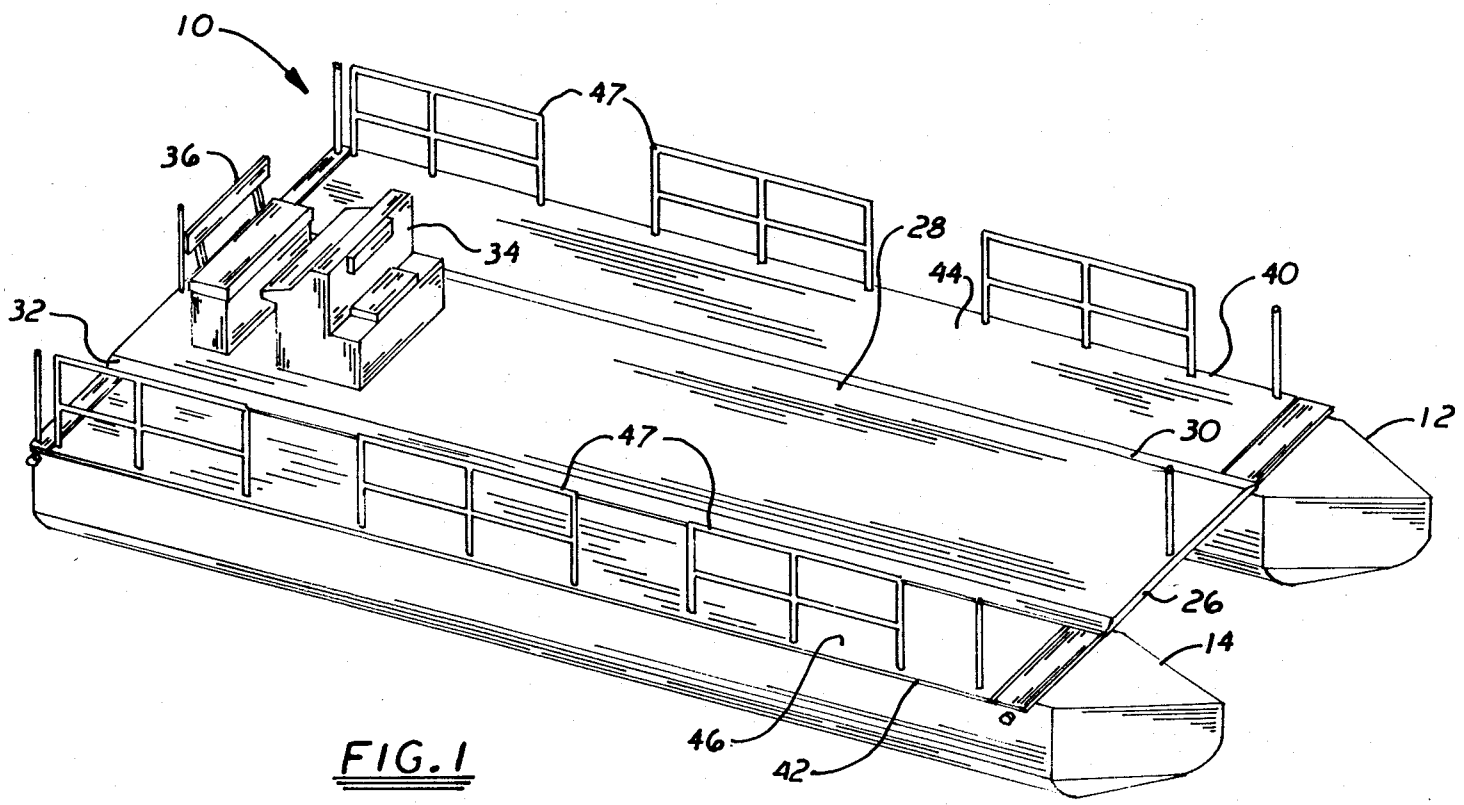
FIG. 1 is a perspective view of a multiple hull boat according to this invention.
Figure 2:
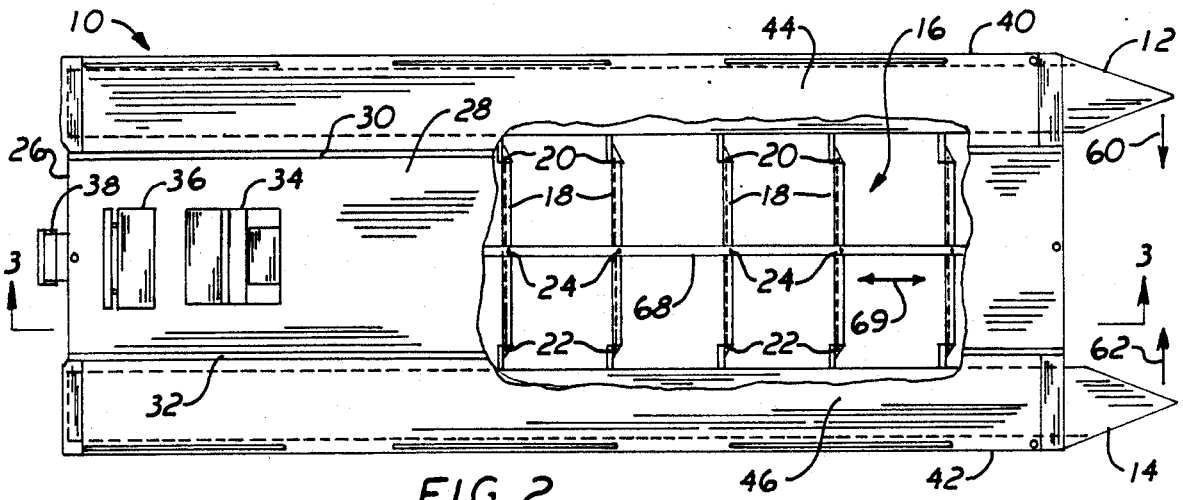
FIG. 2 is a top plan view of the multiple hull boat of FIG. 1 with a portion of the deck cut away to illustrate the collapsible support apparatus.
Figure 4:
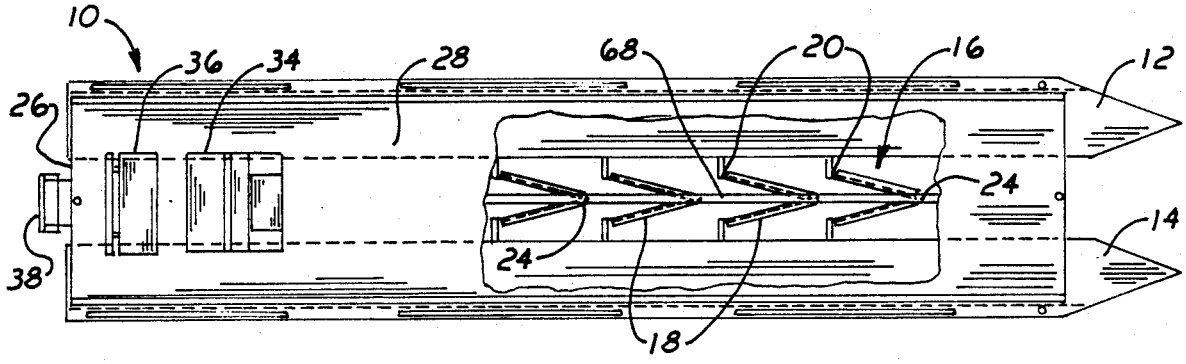
FIG. 4 is a top plan view of the multiple hull boat of FIG. 1 in its collapsed condition.

There is shown in FIG. 1 a collapsible multiple hull boat 10 that includes a pair of hull members 12 and 14. As best shown in FIGS. 2 and 4, hull members 12 and 14 are interconnected by a collapsible apparatus 16. More particularly, collapsible apparatus 16 comprises a plurality of elongate scissor-like toggle mechanisms 18 that are hingeably or pivotably connected at ends 20 and 22 to the hull members 12 and 14, respectively. This pivotable connection is typically made by conventional hinge or other pivot means that will be readily understood by those skilled in the art. Each toggle mechanism 18 also includes a central pivot or hinge 24 that enables the toggle mechanism 18 to fold from the open condition shown in FIG. 2 to the closed condition shown in FIG. 4. The central hinge or pivot 24 is also constructed in a conventional manner. The operation of the toggle mechanisms 18 and collapsible apparatus 16 is explained more fully below.

As shown in FIGS. 1, 2, 4 and 5 a central deck section 26 is located generally above and between hull members 12 and 14. As best shown in FIG. 1, deck section 26 includes an upper surface 28 and a pair of side edges 30 and 32 that preferably are bevelled and extend generally longitudinally of the respective hull members 12 and 14. A control console 34 and driver's seat 36 suitably are mounted on upper surface 28 of central deck section 26 in a conventional manner, proximate the stern of boat 10. As shown in FIGS. 2 and 4, a mounting station 38 for an outboard engine is secured to the stern of the vessel.

Figure 5:
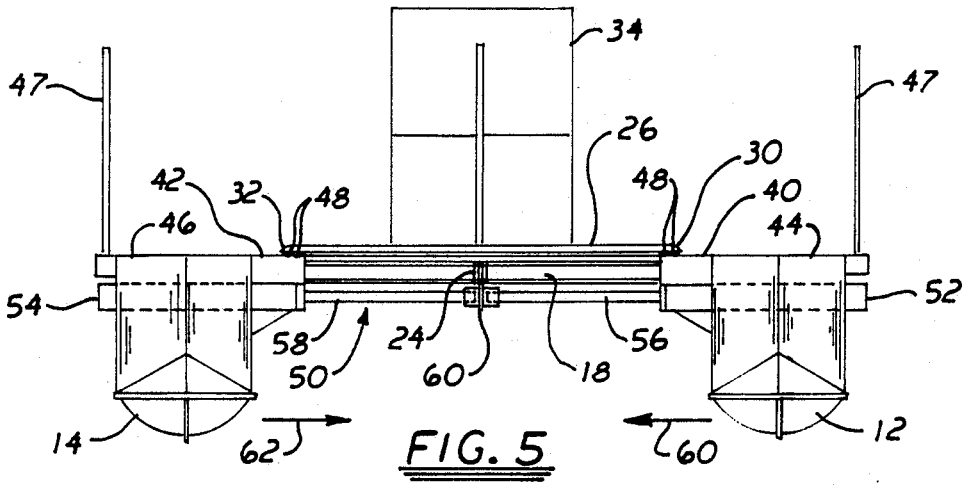
FIG. 5 is a front elevational view of the boat of FIG. 1 in its expanded condition.

As shown in FIGS. 1, 2 and 5, a first deck extension section 40 is mounted to hull member 12 and a second deck extension section 42 is similarly mounted to hull member 14. The deck extension sections 40 and 42 may be integrally formed onto hull members 12 and 14 and, in fact, in certain embodiments the deck extension sections may simply constitute the upper portion of the respective hull members. Alternatively, the deck extension sections 40 and 42 may comprise entirely separate structural elements which are mounted to the hull members by bolts, rivets, pins or similar means of attachment. Deck extension sections 40 and 42 have respective floor portions 44 and 46 that form lateral extensions .of the central deck section 26 when the hull members 12 and 14 and the deck extension sections 40 and 42 are extended in the manner shown in FIGS. 1, 2 and 5. As is apparent from the drawings, the deck extension sections 40 and 42 have a length, measured longitudinal to the hull members 12 and 14, generally greater than one-half the longitudinal length of hull members 12 and 14. A plurality of side rails 47 are typically mounted to the deck extension sections 40 and 42 along the sides of boat 10. The deck extension sections, as well as the hull members and the central deck section are preferably constructed of a sturdy, yet lightweight material such as aluminum. Stainless steel or similar materials may be used for the pivot pins in the collapsible toggle mechanisms 18.

The central deck section 26 is supported relative to deck extension sections 40 and 42 by means such as rollers 48, shown in FIG. 5. More particularly, rollers 48 are axially, rotatably attached in a conventional manner, such as by brackets or within channels, to central deck section 26 proximate each of the bevelled side edges 30 and 32. Each roller is generally tangentially and rotatably engageable with the floor portion 44 and 46 of a respective deck extension section 40 and 42. In FIG. 5, a pair of rollers 48 is shown proximate each side edge 30 and 32 of central deck section 26. Additional pairs of rollers 48 may be similarly arranged along the length of each side edge 30 and 32. These groups of rollers 48 support central deck section 26 on deck extension sections 40 and 42 and permit central deck section 26 to move transversely and translationally relative to deck extensions 40 and 42. Rollers 48 are typically composed of nylon or alternative plastics or other materials that preferably provide relatively low frictional resistance to relative transverse movement between the central deck section 26 and the deck extension sections 40 and 42. Although rollers 48 are illustrated in each of the preferred embodiments shown herein, in alternative embodiments various other means having a low frictional resistance may be provided for supporting the central deck section 26 on the deck extension sections 40 and 42 and permitting relative transverse translational movement between the central deck section and the deck extension sections.

Boat 10 is selectively collapsible and expandable between the positions shown in FIGS. 2 and 4. Although such collapsing and expansion may be performed by hand, it is preferred, particularly in larger embodiments, that a drive mechanism 50, as shown in FIG. 5, be employed for collapsing and expanding boat 10. More specifically, drive mechanism 50 comprises a hydraulic system that includes a pair of hydraulic cylinders 52 and 54 that are mounted to hull members 12 and 14, respectively. Each cylinder accommodates a respective piston and connecting rods 56 and 58 extend from the respective pistons into a centrally disposed mounting yoke 60. Connecting rods 56 and 58 as well as mounting yoke 60 may be enclosed within a collapsible sleeve having a tubular or similar shape. Such a sleeve has been omitted from FIG. 5 for clarity. When such a sleeve is employed the central deck section 26 may be attached to the sleeve by a plate, bracket or similar means so that central deck section is secured to the boat 10. Typically, at least two such drive mechanisms 50 are provided between hull members 12 and 14. Drive mechanism 50, shown in FIG. 5, is located proximate the bow of boat 10. A similar drive mechanism may be provided proximate the stern of the boat. Additional such drive mechanisms may also be provided as needed between the bow and the stern. The hydraulic cylinders 52 and 54 are connected to conventional hydraulic lines, not shown, and are operated by conventional controls and a conventional source of pressurized hydraulic fluid, typically located in console 34.

In operation on the water, boat 10 maintains the extended condition shown in FIGS. 1, 2 and 5. As shown most clearly in FIG. 2, with the boat in its open condition, the toggle mechanisms 18 of collapsible apparatus 16 maintain a generally locked condition so that hull members 12 and 14 are held apart and unintended movement of hull member 12 toward hull member 14 in the direction of arrows 60 and 62 is prevented.

In order to collapse boat 10 for storage and transportation, the toggle mechanisms 18 are urged out of this open, generally locked condition. This may be suitably accomplished by a closure mechanism 64, shown most clearly in FIGS. 2 through 4. Closure mechanism 64 comprises a hydraulic ram 66, shown in FIG. 3, that is mounted beneath central deck section 26 and an elongate closure bar 68 that extends generally longitudinally of boat 10 beneath central deck section 26 and above toggle mechanisms 18. More particularly, hydraulic ram 66 has a driving end that engages the rearmost toggle mechanism 18. Closure bar 68 is connected to each toggle mechanism 18 by the central pivot pin 24 of that toggle mechanism and is reciprocally moveable in the direction of double headed arrow 69. In this manner, all of the toggle mechanisms 18 are connected to and may be pivotably opened and closed by closure bar 18.

Figure 3:
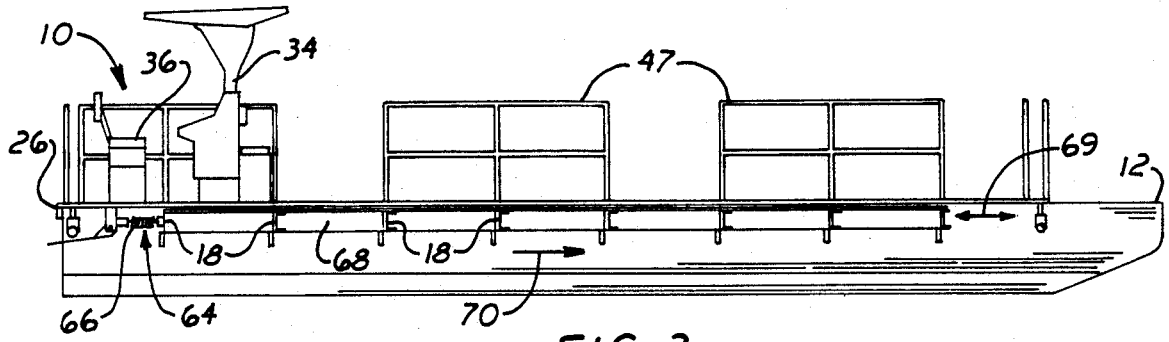
FIG. 3 is an elevational side sectional view of the multiple hull boat taken along line 3—3 of FIG. 2.

Toggle mechanisms 18 are unlocked by actuating hydraulic ram 66, typically by sending an appropriate signal from control console 34, so that ram 66 urges rearmost toggle mechanism 18 out of its locked condition. The rearmost toggle mechanism 18 in turn urges attached closure bar 68 in the direction of arrow 70, as shown in FIG. 3, so that each of the toggle mechanisms 18 is unlocked. At the same time, the drive mechanism 50, shown in FIG. 5, is operated so that cylinders 52 and 54 retract on connecting rods 56 and 58 in the direction of arrows 60 and 62, respectively. The toggle mechanisms 18 pivot closed and boat 10 collapses into the condition shown in FIG. 4. Rollers 48 engage the floor portions 44 and 46 of deck extension sections 40 and 42 and thereby permit the deck extension sections to retract freely beneath respective sides 30 and 32 of central deck section 26. When the hull members 12 and 14 are collapsed, the floor portions 44 and 46 of deck extension sections 40 and 42 are therefore vertically offset from the central deck section 26 and extend beneath the central deck section. Boat 10 is now in a condition for storage or transportion.

Figure 6:
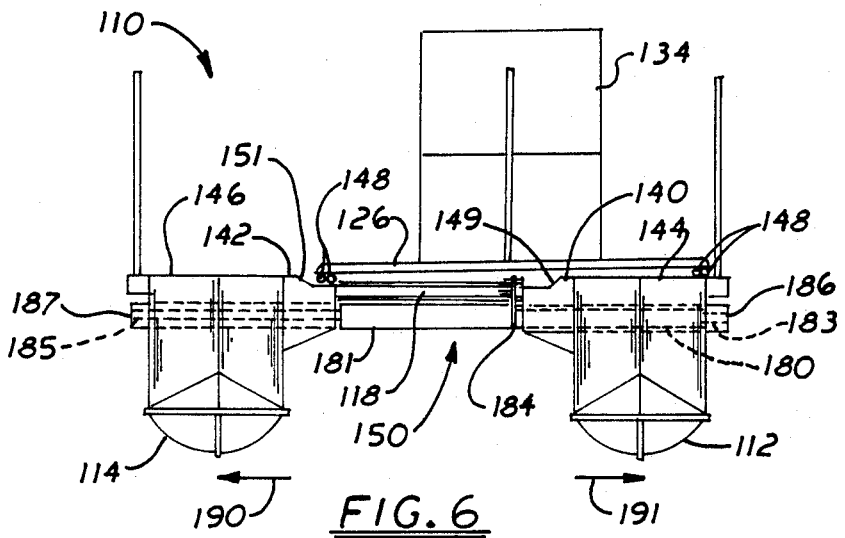
FIG. 6 is a front elevational view of an alternative multiple hull boat according to this invention, in a partially collapsed condition.

Although the above embodiment operates quite satisfactorily to provide an optimum amount of deck space and at the same time convenient collapsibility, the central deck section 26 is in a slightly higher plane than the floor portions 44 and 46 of deck extension sections 40 and 42. In alternative embodiments of this invention a collapsible boat may be provided wherein the central deck section is generally flush with the deck extension sections when the boat is extended. One such embodiment is shown in FIG. 6. Therein, deck extension sections 140 and 142 are mounted on respective hull members 112 and 114. The hull members are interconnected by a collapsible apparatus that includes a plurality of toggle mechanisms 118, as previously described. A central deck section 126 that carries a control console 134 is supported on deck extension sections 140 and 142 by rollers 148 that preferably are axially rotatably mounted to central deck section 126 and tangentially, rotatably engage deck extension sections 140 and 142 in a manner described above. Multiple pairs of rollers may be provided along each side edge of central deck section 126.

Deck extension section 140 includes a floor portion 144 and deck extension section 142 includes a similar floor portion 146. Deck extension section 140 also includes a ramp portion 149 that is connected directly to floor portion 144 and extends at a generally downward angle from floor portion 144. Deck extension section 142 includes a similar ramp portion 151.

Boat 110 is selectively extended and collapsed by a drive mechanism 150. In particular, drive mechanism 150 includes a pair of hydraulic cylinders 180 and 181. Cylinders 180 and 181 are mounted at their interior ends to a cylinder support 184. Each cylinder accommodates a piston having a respective connecting rod 183 and 185 that extends from a respective cylinder 180 and 181 and through a respective tubular chamber 186 and 187 mounted in hull members 112 and 114 respectively. The connecting rods 183 and 185 are attached in a conventional manner to the outboard ends of the respective chambers 186 and 187. Cylinders 180 and 181 fit likewise within chambers 186 and 187, respectively, when the hull members 112 and 114 are collapsed.

In FIG. 6, hull member 114 and its deck extension section 142 are shown in an extended condition, and hull member 112 and its deck extension section 140 are shown in a collapsed condition. More particularly, to extend boat 110 the drive mechanism 150 is operated so that connecting rod 185 extends, as shown, outwardly from cylinder 181 in the direction of arrow 190. Central deck section 126 rolls upon rollers 148 and moves generally translationally relative to deck extension section 146 and rollers 148 roll down ramp 151 to the position shown in FIG. 6. As a result, floor portion 146 is adjusted into generally flush juxtaposition with the upper surface of central deck section 126. Hull member 112 and its respective deck extension section 140 may be similarly extended in the direction of arrow 191 so that the upper surface of central deck section 126 is adjusted to be generally flush with floor portion 144 of deck extension section 140.

The hull member 112 of boat 110 is illustrated as having been retracted or collapsed by operating the hydraulic drive mechanism 150 so that connecting rod 183 is drawn into cylinder 180. As a result, the cylinder 180 is drawn relatively into tubular chamber 186. This causes the rollers 148 on the right hand side of central deck section 126 to roll up ramp 149 and along floor portion 144 of deck extension section 140 until the rollers arrive at the position shown in FIG. 6. The hull member 112 is thereby shown in a collapsed condition with the floor portion 144 of deck extension section 140 located beneath central deck section 126. The boat 110 may be fully collapsed by operating drive mechanism 150 to move hull member 114 into a similar condition to that of hull member 112. Cylinder 181 is drawn into chamber 187 and the lefthand side edge of central deck section 126 rolls up ramp 151 and onto floor portion 146 of deck extension section 142.

Figure 7:
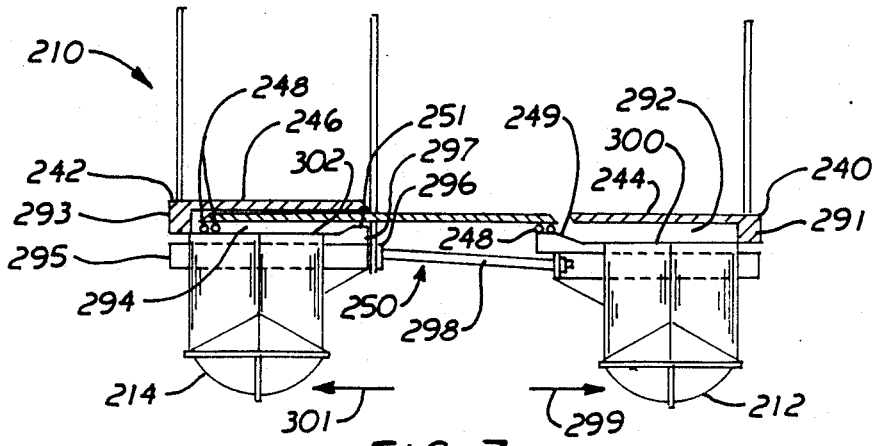
FIG. 7 is a front elevational view of a further alternative multiple hull boat according to this invention, in a partially collapsed condition.

An additional alternative embodiment of boat 210 is shown in FIG. 7 and includes a pair of hull members 212 and 214. Deck extension sections 240 and 242 are mounted respectively to the hull members 212 and 214. Deck extension section 240 includes a floor portion 244, a ramp portion 249 and an intermediate portion 291 that interconnects floor portion 244 and ramp portion 249. Floor portion 244 and ramp portion 249 are vertically spaced apart to define a space 292. Deck extension section 242 similarly includes a floor portion 246, a ramp portion 251 and an intermediate portion 293 that interconnects floor portion 246 and ramp portion 251 and spaces the portions 246 and 251 apart to define a space 294. Central deck section 226 is supported relative to deck extension sections 240 and 242 by means such as rollers 248. Again, additional sets of such rollers may be provided along the length of the side edges of central deck section 226. The rollers 248 provide for relative translational transverse movement between the central deck section 226 and the deck extension sections 240 and 242.

Drive mechanism 250 is employed for selectively extending and collapsing hull members 212 and 214 and the deck extension sections 240 and 242 relative to central deck section 226. In particular, drive mechanism 250 includes hydraulic cylinder 295 that is secured to hull member 214. A telescopic piston is accommodated within cylinder 295 and includes a first actuator 296, conveniently in the form of a second hydraulic cylinder comprising a portion of that piston, that is connected by a connecting apparatus 297 to central deck section 226, and a second actuator such as rod 298 that is telescopically receivable within first actuator 296. The distal end of rod 298 is fixed by conventional fastening means to the hull member 212. Connecting apparatus 297 secures central deck section 226 to the drive mechanism 250 and restricts longitudinal movement of the central deck section.

In FIG. 7, hull member 214 is illustrated in the collapsed condition and hull member 212 is shown in the extended condition. More particularly, to extend the hulls and deck of boat 210 for expanded use on the water, the drive mechanism 250 is operated so that rod 298 extends outwardly in the direction of arrow 299. This causes the rollers 248 on the right hand edge of central deck section 226 to roll along surface 300 of intermediate portion 291 and up ramp portion 249 to the position, shown in FIG. 7, at the inner edge of the deck extension section 240. In this position the upper surface of central deck section 226 is generally flush with the upper surface 244 of deck extension section 240. The boat 210 may be fully opened by continuing the extension of hydraulic drive mechanism 250. First actuator 296 bears against connecting apparatus 297 and, as a result, hull member 214 is urged in the direction of arrow 301. Rollers 248 along the left hand side edge of central deck section 226 roll along surface 302 of intermediate portion 293 and up ramp portion 251 to a position at the inner edge of deck extension section 242. Floor portion 246 of deck extension section 242 is thereby adjusted to be generally flush with the upper surface of central deck section 226.

To collapse boat 210, drive mechanism 250 is operated so that first actuator 296 is drawn into cylinder 295, as shown in FIG. 7. Rollers 248 on the left hand edge of central deck section 226 roll down ramp 251 and along surface 302 so that the left hand edge of the central deck section 226 is drawn into space 294, and into the position shown in FIG. 7. The hydraulic action is continued and rod 298 is retracted into actuator 296, thereby pulling hull member 212 in the direction of arrow 301. This causes the rollers 248 along the right hand edge of central deck section 226 to roll down ramp portion 249 and along surface 300 of intermediate portion 291 until the right hand edge of the deck section is fully received within space 292. In this embodiment, because the central deck section is received within spaces formed in the deck extension sections the control console and seat would typically be mounted on one of the deck extension sections.

Although in each of the above described embodiments of this invention both hull members are moveable and collapsible relative to respective edges of the central deck section, this is not a limitation of the invention. In still other alternative embodiments only one side edge of the central deck section may be moveable relative to one of the deck extension sections and the other side edge may be fixed to its respective deck extension section. Such an embodiment typically would not provide the degree of collapsibility provided when both side edges of the central deck section are moveably supported. However, a certain degree of improved collapsibility is provided by such embodiments. The embodiments described herein are not limited to the particular drive mechanisms disclosed. Other suitable drive mechanisms, such as rack and pinion gears or cables and cranks, among numerous other alternatives may be used with equal facility. Likewise, it is possible for the hull members and deck portions to be expanded and collapsed manually, without any drive mechanism but still within the scope of this invention. Similarly, other structures for supporting the deck members may be used in place of the toggle mechanisms described above. One suitable substitute could be the inclusion of one or more telescoping tubular members, somewhat similar to the tubular members associated with the hydraulic cylinders described above. Obviously, all such tubular members could have either a square or a circular cross section, taken transverse to the axis of the tube, and work with equal facility.

From the foregoing it may be seen that the apparatus of this invention provides for an improved multiple hull boat that may be quickly and conveniently alternated between extended and collapsed conditions while still afloat. While this detailed description has set forth particularly preferred embodiments of the apparatus of this invention, numerous modifications and variations of the structure of this invention, all within the scope of the invention will readily occur to those skilled in the art. Accordingly, it is to be understood that this description is illustrative only of the principles of the invention and is not limitative thereof, the scope of the invention being limited solely by the claims appended hereto.

What is claimed is:

1. A multiple hull boat comprising a pair of elongate, generally parallel hull members, a collapsible and expandable apparatus for interconnecting said hull members, a central deck section located generally above and between said hull members and having a pair of side edges that extend generally longitudinally of the respective said hull members, first and second deck extension sections each mounted to a respective said hull member, each having a length measured longitudinally of said respective hull member greater than one-half the longitudinal length of said hull member, and means for supporting said central deck section relative to said deck extension sections for transverse translational movement relative to at least said first deck extension section, said hull members being selectively moveable apart such that said deck extension sections are extended at least partly beyond the respective said side edges of said central deck section to expand the boat and provide a substantially continuous deck having a transverse width substantially greater than the transverse width of said central deck section and being selectively moveable toward one another such that at least said first deck extension section is retracted at least partly within a respective said side edge of said central deck section to collapse the boat.

2. The boat of claim 1 in which said supporting means include a plurality of roller elements.

3. A multiple hull boat comprising a pair of elongate, generally parallel hull members, a collapsible and expandable apparatus for interconnecting said hull members, a central deck section located generally above and between said hull members and having a pair of side edges that extend generally longitudinally of the respective said hull members, first and second deck extension sections each mounted to a respective said hull member, each having a length measured longitudinally of said respective hull member greater than one-half the longitudinal length of said hull member, and means for supporting said central deck section relative to said deck extension sections for transverse movement relative to at least said first deck extension section in which each said supporting means includes a plurality of roller elements with each said roller element being axially rotatably attached to said central deck section and generally tangentially and rotatably engageable with a respective said deck extension section, said hull members being selectively moveable apart such that said deck extension sections are extended at least partly beyond the respective said side edges of said central deck section to expand the boat and provide a substantially continuous deck having a transverse width substantially greater than the transverse width of said central deck section and being selectively moveable toward one another such that at least said first deck extension section is retracted at least partly within a respective said side edge of said central deck section to collapse the boat.

4. The boat of claim 1 in which said first deck extension section includes a floor portion that is vertically offset from said central deck section when said first deck extension section is retracted and which forms a lateral extension of said central deck section when said first deck extension section is extended.

5. A multiple hull boat comprising a pair of elongate, generally parallel hull members, a collapsible and expandable apparatus for interconnecting said hull members, a central deck section located generally above and between said hull members and having a pair of side edges that extend generally longitudinally of the respective said hull members, first and second deck extension sections mounted respectively to said hull members, said first deck extension section including a floor section that is vertically offset from said central deck section when said first deck extension section is retracted and which forms a lateral extension of said central deck section when said first deck extension section is extended, and said first deck extension section further including a ramp portion that is connected to said floor portion, said ramp portion being engageable with said supporting means for vertically adjusting said central deck section into generally flush juxtaposition with said floor portion of said first deck extension section when said first deck extension section is fully extended; and means for supporting said central deck section relative to said deck extension sections for transverse movement relative to at least said first deck extension section, said hull members being selectively moveable apart such that said deck extension sections are extended at least partly beyond the respective said side edges of said central deck section to expand the boat and provide a substantially continuous deck having a transverse width substantially greater than the transverse width of said central deck section and being selectively moveable toward one another such that at least said first deck extension section is retracted at least partly within a respective said side edge of said central deck section to collapse the boat.

6. The boat of claim 5 in which said supporting means include a plurality of roller elements, each roller element being axially rotatably attached to said central deck section and generally tangentially and rotatably engageable with said first deck extension section.

7. The boat of claim 6 in which said floor portion is tangentially, rotatably engageable by at least one said roller element such that said floor portion is rolled beneath said central deck section when said first deck extension section is retracted, and in which said ramp portion is directly attached to and extends at a generally downward angle from said floor portion to lower said central deck section into generally flush juxtaposition with said floor portion when said first deck extension section is fully extended.

8. The boat of claim 6 in which said deck extension section further includes an intermediate portion for interconnecting said floor portion and said ramp portion such that said floor portion and said ramp portion are spaced vertically apart to define a space for receiving a respective said side edge of said central deck section when said first deck extension section is retracted, and in which said ramp portion extends at a generally upward angle from said intermediate portion to raise said central deck section into generally flush juxtaposition with said floor portion of said first deck extension section when said first deck extension section is fully extended.

9. The boat of claim 1 in which said collapsible apparatus includes at least one toggle mechanism, each said toggle mechanism having a pair of opposed ends that are connected respectively to said hull members and being alternatable between an open, generally locked condition in which said hull members are held apart when said boat is expanded, and a closed condition when said boat is collapsed.

10. The boat of claim 9 further comprising a closure apparatus for selectively urging each said toggle mechanism out of said open, generally locked condition to enable said boat to be collapsed.

11. The boat of claim 1 further comprising a connecting apparatus for securing said central deck section to said collapsible apparatus.

12. The boat of claim 1 further including a drive mechanism for selectively moving said hull members apart and together.

13. A multiple hull boat comprising;

a pair of elongate, generally parallel hull members, a collapsible and expandable apparatus for interconnecting said hull members, a central deck section located generally above and between said hull members and having a pair of side edges that extend generally longitudinally of the respective said hull members, first and second deck extension sections mounted respective to said hull members, each having a length measured longitudinally of said respective hull member greater than one-half the longitudinal length of said hull member, and means for supporting said central deck section relative to said deck extension sections for transverse translational movement relative to at least said first deck extension section to provide a substantially continuous deck having a transverse width substantially greater than the transverse width of said central deck section when said hull members are moved apart, and a drive mechanism for selectively moving said hull members apart, such that said deck extension sections are extended at least partly beyond the respective said side edges of said central deck section to expand the boat, and for selectively moving said hull members together, such that at least said first deck extension section is retracted at least partly within a respective said side edge of said central deck section to collapse the boat.

14. The boat of claim 13 further comprising a connecting apparatus for securing said central deck section to at least one of said collapsible apparatus and said drive mechanism.

15. A multiple hull boat comprising;

a pair of elongate, generally parallel hull members, a collapsible and expandable apparatus for interconnecting said hull members, a central deck section located generally above and between said hull members and having a pair of side edges that extend generally longitudinally of the respective said hull members, first and second deck extension sections each mounted to a respective said hull member, each having a length measured longitudinally of said respective hull member greater than one-half the longitudinal length of said hull member, and means for supporting said central deck section relative to said deck extension sections for transverse translational movement relative to said first and second deck extension sections, said hull members being selectively moveable apart such that said first and second deck extension sections are extended at least partly beyond the respective said side edges of said central deck section to expand the boat and provide a substantially continuous deck having a transverse width substantially greater than the transverse width of said central deck section, and being selectively moveable together such that said first and second deck extension sections are retractable at least partly within said respective side edges of said central deck section to collapse the boat.

16. The boat of claim 15 in which said supporting means include a plurality of roller elements.

17. A multiple hull boat comprising:

a pair of elongate, generally parallel hull members, a collapsible and expandable apparatus for interconnecting said hull members, a central deck section located generally above and between said hull members and having a pair of side edges that extend generally longitudinally of the respective said hull members, first and second deck extension sections each mounted to a respective said hull member, each having a length measured longitudinally of said respective hull member greater than one-half the longitudinal length of said hull member and means for supporting said central deck section relative to said deck extension sections for transverse movement relative to said first and second deck extension sections, said supporting means including a plurality of roller elements, in which each said roller element is axially rotatably attached to said central deck section and generally tangentially and rotatably engageable with a respective said deck extension section, said hull members being selectively moveable apart such that said first and second deck extension sections are extended at least partly beyond the respective said side edges of said central deck section to expand the boat, and moveable together such that said first and second deck extension sections are retractable at least partly within said respective side edges of said central deck section to collapse the boat.

18. The boat of claim 15 in which each said deck extension section includes a floor portion that is vertically offset from said central deck section when said deck extension section is retracted and which forms a lateral extension of said central deck section when said deck extension section is extended.

19. A multiple hull boat comprising;

a pair of elongate, generally parallel hull members, a collapsible and expandable apparatus for interconnecting said hull members, a central deck section located generally above and between said hull members and having a pair of side edges that extend generally longitudinally of the respective said hull members, with each said deck extension section including a floor portion that is vertically offset from said central deck section when said deck extension section is retracted and which forms a lateral extension of said central deck section when said deck extension section is extended, and in which each said deck extension section further includes a ramp portion that is connected to said floor portion, said ramp portion being engageable with said supporting means for vertically adjusting said central deck section into generally flush juxtaposition with said floor portion of said deck extension section when said deck extension section is fully extended, and means for supporting said central deck section relative to said deck extension sections for transverse movement relative to said first and second deck extension sections, said hull members being selectively moveable apart such that said first and second deck extension sections are extended at least partly beyond the respective said side edges of said central deck section to expand the boat and provide a substantially continuous deck having a transverse width substantially greater than the transverse width of said central deck section, and being selectively moveable together such that said first and second deck extension sections are retractable at least partly within said respective side edges of said central deck section to collapse the boat.

20. The boat of claim 19 in which said supporting means include a plurality of roller elements, each roller element being axially, rotatably attached to said central deck section and generally tangentially and rotatably engageable with a respective said deck extension section.

21. The boat of claim 20 in which said floor portion is tangentially, rotatably engageable by at least one said roller element such that said floor portion is rolled beneath said central deck section when said deck extension section is retracted and in which said ramp portion is directly attached to and extends at a generally downward angle from said floor portion to lower said central deck section into generally flush juxtaposition with said floor portion when said deck extension section is fully extended.

22. The boat of claim 20 in which said deck extension section further includes an intermediate portion for interconnecting said floor portion and said ramp portion such that said floor portion and said ramp portion are spaced vertically apart to define a space for receiving a respective said side edge of said central deck section when said deck extension section is retracted, and in which the ramp portion extends at a generally upward angle from said intermediate portion to raise said central deck section into generally flush juxtaposition with said floor portion of said deck extension section when said deck extension section is fully extended.

* * * * *